US007098905B2

(12) United States Patent
Abe et al.

(10) Patent No.: US 7,098,905 B2
(45) Date of Patent: Aug. 29, 2006

(54) ACTIVE MATRIX TYPE ORGANIC EL PANEL DRIVE CIRCUIT AND ORGANIC EL DISPLAY DEVICE

(75) Inventors: Shinichi Abe, Kyoto (JP); Masanori Fujisawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 426 days.

(21) Appl. No.: 10/629,541

(22) Filed: Jul. 30, 2003

(65) Prior Publication Data

US 2005/0099368 A1 May 12, 2005

(30) Foreign Application Priority Data

Aug. 2, 2002 (JP) ..... 2002-225597

(51) Int. Cl.
*G09G 3/10* (2006.01)

(52) U.S. Cl. ..... 345/214; 345/36; 345/90; 313/504; 313/505; 315/169.3

(58) Field of Classification Search ..... 345/36, 345/45, 76, 90, 204, 214; 313/504, 505; 315/169.3

See application file for complete search history.

(56) References Cited

U.S. PATENT DOCUMENTS 4,991,119 A * 2/1991 Traa ..... 348/185
5,070,236 A * 12/1991 Miyake ..... 250/208.1
5,684,365 A 11/1997 Tang et al.
5,812,104 A * 9/1998 Kapoor et al. ..... 345/76
5,990,629 A * 11/1999 Yamada et al. ..... 315/169.3
6,246,384 B1 * 6/2001 Sano ..... 345/76
6,323,847 B1 * 11/2001 Kaneko et al. ..... 345/204
2001/0026251 A1 * 10/2001 Hunter et al. ..... 345/55
2001/0052597 A1 * 12/2001 Young et al. ..... 257/59
2001/0055008 A1 * 12/2001 Young et al. ..... 345/204
2002/0063672 A1 * 5/2002 Stevens ..... 345/89

FOREIGN PATENT DOCUMENTS

JP 10-112391 4/1998
JP 11-143429 5/1999

* cited by examiner

*Primary Examiner*—Bipin Shalwala
*Assistant Examiner*—Vincent E. Kovalick
(74) *Attorney, Agent, or Firm*—Mattingly, Stanger, Malur & Brundidge, P.C.

(57) ABSTRACT

A drive circuit of an active matrix type organic EL display panel includes a plurality of current drive circuits provided correspondingly to data lines or column pins of the display panel, a plurality of pixel circuits, each of which includes a capacitor and an organic EL element, and a write control circuit. The current drive circuit includes an output pin connected to the data line or the column pin and generates a current for charging the capacitor to a predetermined voltage through the data line or the column pin and a current for initially charging the organic EL element. The write control circuit performs a write control for storing the voltage in the capacitor and a resetting control for of the capacitor written with the voltage.

17 Claims, 4 Drawing Sheets

FIG. 2

| | SELECTION LINE, ERASE LINE | | | CONTROL SIGNAL | | | TRANSISTORS OF PIXEL CIRCUIT | | | | | CURRENT PATH |
|---|---|---|---|---|---|---|---|---|---|---|---|---|
| | Y1 | Y2 | Y3 | S1 | S2 | S3 | Tr1 | Tr2 | Tr3 | Tr4 | Tr5 | |
| INITIAL CHARGE OF CAPACITOR C | "L" | "L" | "H" | "L" | "H" | "H" | ON | ON | ON | OFF | OFF | ① |
| VOLTAGE WRITE IN CAPACITOR C | "L" | "L" | "H" | "L" | "L" | "H" | ON | ON | ON | OFF | OFF | ② |
| INITIAL CHARGE OF OEL ELEMENT | "L" | "H" | "H" | "H" | "L" | "L" | ON | OFF | ON | ON | OFF | ③ |
| LIGHT EMITTING DRIVE OF OEL ELEMENT | "H" | "H" | "H" | "L" | "L" | "L" | OFF | OFF | ON | ON | OFF | ④ |
| RESETTING OF CAPACITOR C AND OEL ELEMENT | "L" | "H" | "L" | "L" | "H" | "L" | ON | OFF | OFF | ON | ON | ⑤ |

ACTIVE MATRIX TYPE ORGANIC EL PANEL DRIVE CIRCUIT AND ORGANIC EL DISPLAY DEVICE

BACKGROUND OF THE INVENTION

1. Field of the Invention

The present invention relates to an active matrix type organic EL drive circuit and an organic EL display device and, in particular, the present invention relates to an active matrix type organic EL display device of a portable telephone set or a PHS, etc., which is capable of performing an initial charging (charging at light emission start time for emitting light earlier) of organic EL elements of an active matrix type organic EL panel, reducing a time required to write a drive current value to a capacitor of a pixel circuit and improving luminance of the organic EL elements and which is suitable for a high luminance color display.

2. Description of the Prior Art

It has been known that an organic EL display device, which realizes a high luminance display by spontaneous light emission, is suitable for a display on a small display screen and the organic EL display device has been attracting public attention as the next generation display device to be mounted on a portable telephone set, a PHS, a DVD player or a PDA (Personal Digital Assistants), etc. Known problems of such organic EL display device are that, since, when it is driven by voltage as in a liquid crystal display device, luminance variation thereof becomes substantial and that, since there is difference in sensitivity of organic EL element between R (red), G (green) and B (blue), a control of luminance of a color display becomes difficult.

In view of these problems, an organic EL display device using current drive circuits has been proposed recently. For example, JPH10-112391A discloses a technique in which the luminance variation problem is solved by employing a current drive system.

An organic EL display panel of an organic EL display device for a portable telephone set, a PHS, etc., having 396(=132×3) terminal pins for column lines and 162 terminal pins for row lines has been proposed. However, there is a tendency that the number of column lines as well as row lines is further increased.

An output stage of a current drive circuit of such organic EL display panel of either the active matrix type or the passive matrix type includes a current source drive circuit, such as an output circuit constructed with a current mirror circuit, for each of the terminal pins.

In the active matrix type organic EL display panel, a pixel circuit composed of a capacitor and a transistor is provided for each display cell (pixel). An organic EL element (referred to as "OEL element", hereinafter) is current-driven through the transistor, which is driven correspondingly to a voltage stored in the capacitor. The drive system is either a digital drive system in which the drive current of the OEL element is binary-controlled and an analog control in which the drive current is controlled by an analog input data. In the case of the digital drive system, a display area is controlled by providing a sub pixel in the pixel or the tone of the display element is controlled according to a drive time by a time-division of a light emitting time. In the case of the analog drive system, there are a voltage setting type (voltage program system) and a current setting type (current program system). In the voltage setting type system, a terminal voltage of the capacitor of each pixel circuit is set according to a voltage signal and, in the current setting type system, the terminal voltage of the capacitor is set according to a current signal.

In such active matrix type OEL panel, an unevenness of luminance tends to occur due to variation of an operating threshold value of the drive transistor of each pixel circuit. Since it is difficult to unify the operating threshold value of the drive transistor of each display element in a manufacturing process, it has been considered to restrict the luminance variation by controlling the voltage of the capacitor of each pixel circuit. In order to realize this, a threshold compensation circuit is provided in the pixel circuit. As an example of the compensation circuit, there are a circuit of the above mention voltage program system and a circuit of the current program system.

The voltage program system uses four transistors and two capacitors in each pixel circuit and includes two lines for compensating for variation of the operating threshold value of the drive transistor in addition to a data line and a selection line. A current drive, which is not influenced by the threshold value of the drive transistor is performed by charging the two capacitors with a predetermined timing by applying a control signal to the two lines of the voltage program system.

The current program system is constructed with three transistors including a drive transistor and a switch transistor for setting a specific voltage. In addition to a data line and two selection lines, a power source line of the specific voltage Vdd. First, the drive transistor is disconnected by the switch transistor to charge the capacitor. Thereafter, the drive transistor is connected to the capacitor by the switch transistor to supply power from the source line to thereby current-drive the OEL element.

Incidentally, a current drive circuit of a passive matrix type organic EL display panel uses current having a peak current, for restricting luminance variation by emitting light earlier by charging the OEL element having a capacitive load characteristics. On the other hand, the active matrix type organic EL display panel temporarily writes a voltage corresponding to a drive current in the capacitor of the pixel circuit and then generates the drive current corresponding to the written voltage of the capacitor. Therefore, the OEL element of the active matrix type organic EL panel is not driven by a peak current. As a result, it is impossible to emit light earlier as in the passive matrix type organic EL panel and the write time for writing the drive current is necessary. Therefore, it has a problem that a light emitting period is reduced.

The writing of the drive current is usually performed by charging the capacitor of the pixel circuit, which is usually several hundreds pF, with a current of about 0.1 μA to 10 μA and the time required to write the drive current is as long as about 10% or more of the scan period. The light emitting time is reduced correspondingly, resulting in reduction of display luminance. Particularly, when the number of display pixels is increased as in VGA, XGA, etc., in which the time control must be performed within a limited time, the previously mentioned defect becomes serious.

SUMMARY OF THE INVENTION

An object of the present invention is to provide a drive circuit of an active matrix type organic EL display panel, which is capable of initially charging OEL elements of the organic EL display panel and improving luminance of the OEL elements and which is suitable for high luminance color display.

Another object of the present invention is to provide an organic EL display device capable of initially charging OEL elements of an active matrix type organic EL display panel and improving luminance of the OEL elements.

A further object of the present invention is to provide a drive circuit of an active matrix type organic EL display panel capable of reducing time required to write a drive current in a capacitor of a pixel circuit and improving luminance of OEL elements and an organic EL display device using the drive circuit.

In order to achieve the above objects, according to a first aspect of the present invention, the drive circuit is featured by comprising a plurality of current drive circuits provided correspondingly to data lines or column pins, the current drive circuits including output pins connected to the data lines or the column pins, generating currents for charging capacitors of pixel circuits to predetermined voltage through the data lines or the column pins and generating currents for initially charging organic EL elements, and a write control circuit for performing a write control for write the voltages in the capacitors and resetting the voltage values of the capacitors written therein.

According to a second aspect of the present invention, each of the current drive circuits generates current for initially charging the capacitor of the pixel circuit connected thereto through the output pin within a short time.

As mentioned, according to the first aspect of the present invention, the current drive circuit outputs current corresponding to the drive current of the OEL element, for charging the capacitor of the pixel circuit and outputs current for initially charging the OEL element, so that it becomes possible to initially charge the OEL element in the active matrix type organic EL display panel. Further, since the OEL elements are initially charged by power externally of the pixel circuit, it is possible to set the initial charge current of the OEL element to a large value. Since, therefore, the OEL element can emit light earlier by the drive current of the pixel circuit, it is possible to increase the light emitting period of the OEL element correspondingly.

According to the second aspect of the present invention, the current drive circuit outputs the current for initially charging the capacitor of the pixel circuit. Therefore, it is possible to reduce the write time for writing the current value in the capacitor of the pixel circuit.

As a result, luminance of the OEL element can be improved and the drive current for the active matrix type organic EL display panel suitable for high luminance color display and the organic EL display device using the same drive circuit can be realized.

BRIEF DESCRIPTION OF THE DRAWINGS

FIG. 2 is a timing control table for lines to be scanned in Y direction (row direction);

DETAILED DESCRIPTION OF THE PREFERRED EMBODIMENTS

Figure 1:
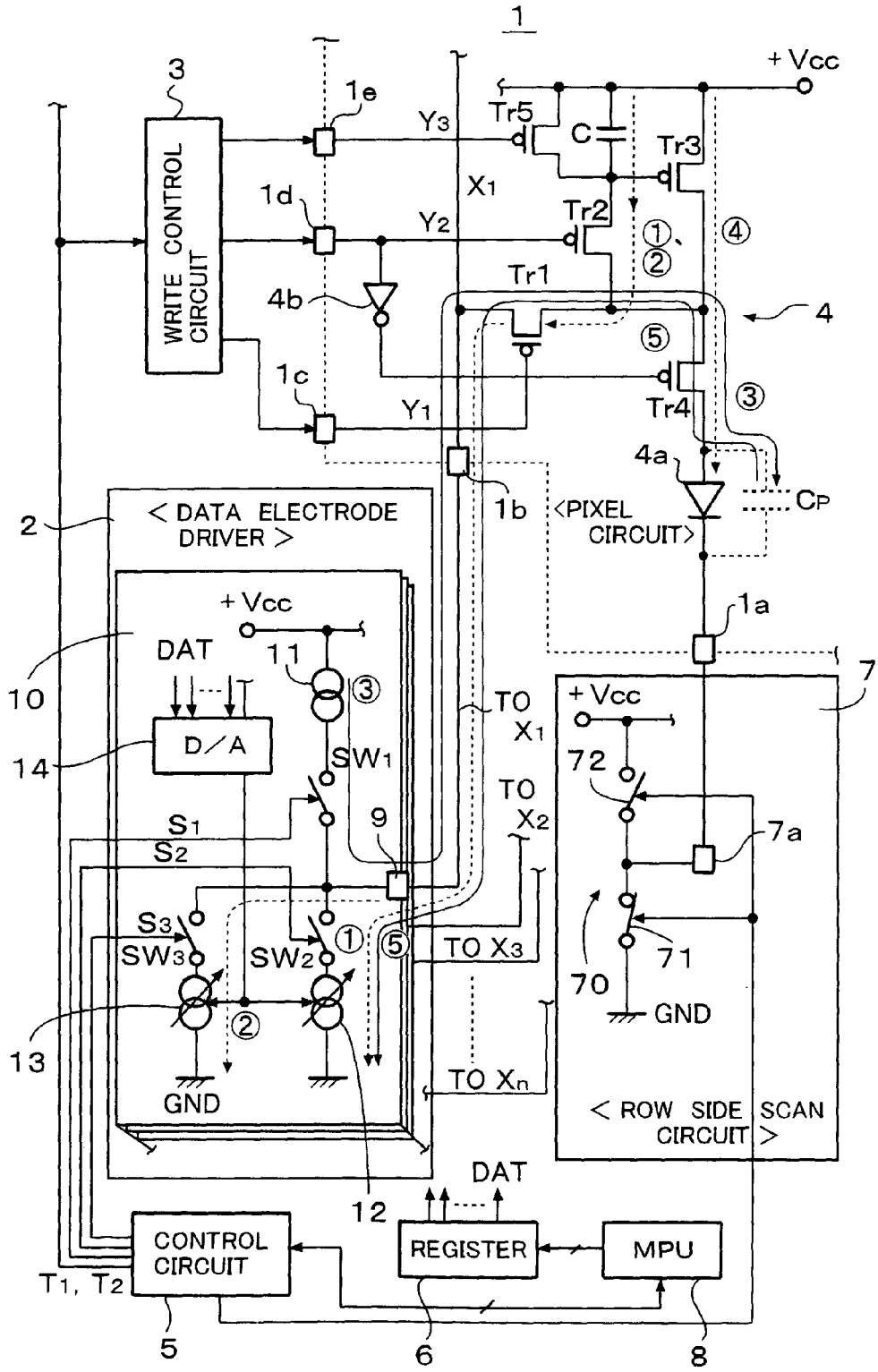
FIG. 1 is a block circuit diagram of an active matrix type organic EL display device according to an embodiment of the present invention.

FIG. 1 shows an active matrix type organic EL display device 1 constructed with a data electrode driver 2, a write control circuit 3, pixel circuits 4, a control circuit 5, a register 6, a row side scan circuit 7 and a MPU 8, etc. The pixel circuits 4 are provided at cross points of an X-Y matrix, respectively, although only one pixel circuit is shown in FIG. 1.

The data electrode driver 2 is a column driver (driver in horizontal scan direction) of the organic EL drive circuit and includes display cell driver circuits 10 provided correspondingly to data lines or column pins. Output pins 9 of the display drive circuits 10 are connected to the data lines (X electrodes X1, X2, X3, . . . Xn) of the X-Y matrix wiring (data lines and scan lines), respectively.

The display cell drive circuits 10 provided correspondingly to the data lines (column pins) initially charge capacitive loads each including a current write capacitor of the pixel circuit 4 and an OEL element 4*a*, current-drive them and discharge residual charge of the OEL elements 4*a*. Incidentally, a capacitor Cp provided in parallel to the OEL element 4*a* and shown by dotted line is a parasitic capacitor formed by a junction capacitance of the OEL element 4*a*.

The display cell drive circuit 10 is constructed with a push-pull circuit including a push side current source 11 and a pull side current sources 12 and 13. The push side current source 11 is connected to the output pin 9 through a switch circuit SW1 and the pull side current sources 12 and 13 are connected to the output pin 9 through switch circuits SW2 and SW3, respectively. The output pin 9 is connected to the data line X1 through a terminal 1*b* of the organic EL display panel.

The push side current source 11 generates current for initially charging the OEL element 4*a*. The pull side current source 12 generates current for initially charging a capacitor C and is also used as a current source for resetting the OEL element 4*a*. The pull side current source 13 generates current for writing a predetermined voltage value in the capacitor C.

Incidentally, since other display cell drive circuits 10 connected to other data lines than the data line X1 have constructions identical to that of the display cell drive circuit 10 connected to the data line X1, description of these other display cell drive circuits is omitted.

The switch circuits SW1, SW2 and SW3 are ON/OFF controlled by levels "H" or "L" of control signals S1, S2 and S3 supplied from the control circuit 5, respectively. The current values of the pull side current sources 12 and 13 are constant current sources having current values determined according to current outputted by a D/A converter circuit 14. The current outputted by the D/A converter circuit 14 is generated by converting a display data DAT set in the register 6 by the MPU 8.

Incidentally, concrete circuits of the constant current source and the D/A converter circuit of the drive circuit of the active matrix type organic EL display panel are shown in U.S. patent application Ser. Nos. 10,360,715 or 10,463,579.

As shown in FIG. 1, each of the pixel circuits (display cells) 4 are provided correspondingly to cross points of the X-Y matrix including a plurality of scan lines Y, each including a selection line Y1, a selection line Y2 and an erase line Y3, arranged perpendicularly to the data lines X1, X2, . . . Xn in the column direction, respectively. For example, the shown pixel circuit 4 includes P channel MOS transistors Tr1, Tr2 and Tr3. The transistor Tr1 has a gate and a drain connected to the selection line Y1 and the data line X1, respectively, and is arranged at the cross point of these lines. A source of the transistor Tr1 is connected to a gate of the P channel MOS transistor Tr3, which drives the OEL element, through a drain-source circuit of the P channel MOS transistor Tr2.

The capacitor C for storing the drive current is connected between the source and the gate of the transistor Tr3 and the source of the transistor Tr3 is connected to a power source line +Vcc of about +7V. The drain of the transistor Tr3 is connected to a source of a P channel transistor Tr4 provided in a downstream side of the transistor Tr3, which drives the OEL element. A drain of the transistor Tr4 is connected to an anode of the OEL element 4*a*.

A cathode of the OEL element 4*a* is connected to an input/output terminal 7*a* of a switch circuit 70 of the row side scan circuit 7 through the terminal 1*a* of the organic EL display panel and then selectively grounded through the switch circuit 70 or connected to the power source line +Vcc.

The gate of the transistor Tr2 is connected to the selection line Y2 which is connected to a gate of the transistor Tr4 through an inverter 4*b*. A P channel MOS transistor Tr5, which has a source and a drain connected to terminals of the capacitor C, respectively, is connected to the erase line Y3.

The selection lines Y1 and Y2 and the erase line Y3 are connected to the write control circuit 3 through respective terminals 1*c*, 1*d* and 1*e* of the organic EL display panel. The Y lines each including the selection lines Y1 and Y2 and the erase line Y3 are sequentially scanned according to the control signals from the write control circuit 3 and the Y scan in the Y direction (row direction) is performed in synchronism with the scan of the row side scan circuit 7.

In the active matrix type organic EL display panel, the resetting of the OEL elements in the whole screen area is performed after light emission of all of the OEL elements completes or immediately before the write of the voltage value in the capacitors C of the pixel circuits correspondingly to the row line scan. Since only one pixel circuit is shown in FIG. 1, the case where the resetting is performed after the light emission of the OEL elements will be described in order to simplify the explanation of the resetting.

The selection lines Y1 and Y2 and the erase line Y3 of the Y line to be scanned are set to High ("H") and Low ("L") as shown in a table in FIG. 2. With the setting of these lines, the transistors Tr1 to Tr5 are ON/OFF controlled. Simultaneously therewith, the display cell drive circuit 10 receives the control signals S1, S2 and S3 from the control circuit 5, so that the initial charge (peak current drive) of the capacitor C is performed through a current path ① shown by a dotted line, the write of the current in the capacitor C is performed through a current path ② shown by a dotted line, the initial charge of the OEL element 4*a* is performed through a current path ③ shown by a solid line and then a light emitting drive of the OEL element 4*a* by the pixel circuit 4 is performed through a current path ④ shown by a dotted line. Finally, the resetting of the capacitor is performed through a current path ⑤ shown by a solid line. Thus, the scan of the Y line completes.

A scan of a next Y line is performed similarly through the current paths ① to ⑤. This operation is sequentially repeated from scan line to scan line in Y direction (Row direction).

Incidentally, the lines Y each including the selection lines Y1 and Y2 and the erase line Y3 are provided for the pixel circuits in the row direction (vertical direction), respectively, and connected to the write control circuit 3. In FIG. 1, however, the relation to only one pixel circuit and the related line Y to be scanned in the row direction is shown similarly to the switch circuit 70 of the row side scan circuit 7.

The switch 71 of the switch circuit 70 of the row side scan circuit 7 is turned ON after a drive current for one line corresponding to one line in the horizontal scan direction of R, G and B is written in the capacitors C of the respective pixel circuits (display cells) 4, so that the cathodes of the OEL elements 4*a* are grounded and the OEL elements 4*a* for one line in the horizontal scan direction are driven simultaneously.

The push-pull type switch circuits 70 are provided in the row side scan circuit 7 correspondingly to the scan lines in the row direction.

In the switch circuit 70 connected to the line Y to be scanned, the pull side switch 71 is turned ON and the push side switch 72 is turned OFF. With this operation of the switch circuit 70, the cathode of the OEL element 4*a* is grounded. In this case, the pull side switch 71 of the switch circuit 70, for which the scan is completed, is turned OFF and the push side switch 72 thereof is turned ON. The scan line whose scan is over is pulled up to "H".

In the active matrix type organic EL display panel, the capacitor C stores the drive current. Therefore, it may be possible to turn the switches 71 of the switch circuits 70 ON and turn the switches 72 thereof OFF after the drive currents are stored in the capacitors C of the respective pixel circuits for one screen. In such case, it is enough to provide one switch circuit 70 and the row side scan circuit 7 becomes unnecessary. When one screen of R, G and B is driven in time-division, a total of three switch circuits 70 are provided since the one screen is provided for each of the R, G and B.

Electric charges written in the capacitor C is discharged rapidly through the transistor Tr5 when the transistor Tr5 is turned ON by making the erase line Y3 in "L" state by the write control circuit 3. As mentioned previously, this resetting may be performed during a preceding retrace line period when the voltage is written in the capacitor C of the pixel circuit correspondingly to the row line scan.

Incidentally, the selection lines Y1 and Y2 and the erase line Y3 are scanned upon timing signals T1 and T2 from the write control circuit 3. Further, the write control circuit 3 for performing the above mentioned scan is controlled by the control circuit 5.

FIG. 2 shows a timing control table for the lines to be scanned in the Y direction (row direction) scan. In FIG. 2, levels of the selection lines Y1 and Y2 and the erase line Y3, levels of the control signals S1, S2 and S3, states of the transistors of the pixel circuit corresponding to the levels of the line Y and the current paths formed thereby are shown for the initial charge of the capacitor C, the voltage write in the capacitor C; the initial charge of the EL element, the drive of the EL element 4*a* and the resetting of the capacitor C and the EL element 4*a*.

In the initial charge (peak current drive) of the capacitor C shown in a first line of the table, the selection line Y1, the selection line Y2 and the erase line Y3 are made "L", "L" and "H", respectively, so that the transistors Tr1 and Tr2 are turned ON and the transistors Tr4 and Tr5 are turned OFF. The control signals S1, S2 and S3 are made "L", "H" and "H", respectively, so that the switch circuits SW2 and SW3 are turned ON and the switch circuit SW1 is turned OFF.

Incidentally, each of the switch circuits SW1, SW2 and SW3 is turned ON by the control signal "H" from the control circuit 5. In the initial state, the control signals S1, S2 and S3 are "L" and the switch circuits SW1, SW2 and SW3 are in OFF state.

Therefore, drive currents from the constant current sources 12 and 13 flow from the power source line +Vcc in the current path ① through the switch circuits SW2 and SW3, which are in ON state, and the transistors Tr1 and Tr2, which are ON state. In this case, large charging current corresponding to the peak current flows for a short time, so that the capacitor C is initially charged earlier. As a result, the transistor Tr3 is also turned ON.

In a second line of the table, the current value write in the capacitor C to be performed next is performed while levels of the selection lines Y1 and Y2 and the erase line Y3 and the states of the transistors Tr1, Tr2, Tr3, Tr4 and Tr5 are kept as those in the initial charge of the capacitor C. Under this condition, the switch circuit SW2 is turned OFF by making the control signal S2 "L". The control signals S1, S2 and S3 in this case become "L", "L" and "H", respectively, so that the switch circuits SW1 and SW3 are kept OFF and ON, respectively.

Therefore, the drive current from the constant current source 13 flows from the power source line +Vcc of the pixel circuit 4 through the transistors Tr2 and Tr1, the output pin 9 and the switch circuit SW3 along the current path ②. Thus, the charging current corresponding to the drive current of the OEL element flows to the capacitor C, so that the capacitor C is set to a voltage corresponding to the drive current.

In the initial charge (peak current drive) of the OEL element 4*a* shown in the third line of the table, the transistors Tr2 and Tr4 are turned OFF and ON, respectively, by making the selection lines Y1 and Y2 and the erase line Y3 "L", "H" and "H", respectively. In this case, the transistors Tr1 and Tr5 are kept "ON" and "OFF", respectively.

Under this condition, the initial charge (peak current drive) of the OEL element 4*a* is performed by making the switch circuit SW1 ON for a constant period in which the peak current is generated by making the control signals S1, S2 and S3 "H", "L" and "L", respectively. In this case, the switch circuits SW2 and SW3 are kept OFF. Simultaneously therewith, the switches 71 and 72 of the switch circuit 70 of the row side scan circuit 7 become ON and OFF, respectively, and the display period for light emission of the OEL element 4*a* is started.

Therefore, the drive current from the constant current source 11 flows from the power source line +Vcc of the display cell drive circuits 10 through the switch circuit SW1, the output pin 9, the transistors Tr1 and Tr4, along the current path ③. Thus, large charging current corresponding to the peak current flows for a short time, so that the OEL element 4*a* is initially charged earlier. Simultaneously therewith, a drive current corresponding to the voltage stored in the capacitor C flows from the power source line +Vcc of the pixel circuit 4 through the transistors Tr3 and Tr4, which are turned ON, In the light emitting drive of the OEL element 4*a* shown in the fourth line of the table, the selection line Y1 is made "H" to turn the transistor Tr1 OFF. In this case, the selection line Y1, the selection line Y2 and the erase line Y3 becomes "H", "H" and "H", respectively, and the transistors Tr2 and Tr5 are kept "OFF. As a result, a drive current corresponding to the voltage stored in the capacitor C flows from the power source line +Vcc of the pixel circuit 4 through the transistors Tr3 and Tr4, which are turned ON, along the current path ④. Therefore, a predetermined drive current is supplied to the OEL element 4*a* and the OEL element 4*a* continues the emission of light having luminance corresponding to the predetermined current. When the transistor Tr1 is turned OFF, the pixel circuit 4 is disconnected from the output pin 9.

In this case, the control signals S1, S2 and S3 are "L", "L" and "L", respectively, and the switch circuits SW1, SW2 and SW3 are OFF, so that no current flows in the display cell drive circuit 10.

When, after the display period during which the OEL element 4*a* emits light is over, the pull side switch 71 of the switch circuit 70 of the row side scan circuit 7 becomes OFF and the push side switch 72 thereof becomes ON, the resetting operation of the capacitor C and the OEL element 4*a* is started.

As shown in the fifth line of the table, the selection line Y1 and the erase line Y3 are made "L" to turn the transistors Tr1 and Tr5 ON and the transistor Tr3 OFF. In this case, the selection line Y1, the selection line Y2 and the erase line Y3 becomes "L", "H" and "L", respectively, and the transistor Tr2 is kept OFF.

Since the transistor Tr4 is ON and the transistor Tr3 is OFF, no drive current flows from the pixel circuit 4 to the OEL element 4*a*. During the resetting period, the pull side switch 71 of the switch circuit 70 is kept ON. In order to perform the resetting operation, the level of the control signal S2 is further changed to "H" to turn the switch circuit SW2 ON.

Therefore, charge on the capacitor C is discharged rapidly through the transistor Tr5. Simultaneously therewith, charge on the parasitic capacitor Cp of the OEL element 4*a* is also discharged rapidly through the transistor Tr1, the output pin 9, the switch circuit SW2 and the constant current source 12 along the current path ⑤.

Incidentally, in this case, the control signals S1, S2 and S3 are "L", "H" and "L", respectively, and the switch circuits SW1 and SW3 are kept OFF.

When the row lines are sequentially scanned by the row side scan circuit 7, the resetting is usually performed before storing the voltage in the capacitor C. In such case, the write of the current in the capacitor C is performed through a current paths ① and ② in the resetting period after the resetting operation of the capacitor C and the OEL element 4*a* is performed through a current path ⑤, and then the switch 71 is turned ON to cause the OEL element of that scan line to emit light. After this light emission, the resetting period of the next scan line is started. In such case, the resetting period precedes the light emission period (display period).

At the start time of the next resetting period, the cathode of the OEL element connected to a row line, the scan of which is completed, is pulled up to "H" and the scan on the row side of that line completes.

In such case, the resetting period precedes the light emission period (display period). Therefore, in resetting the capacitor C and the OEL element, which are connected to the line to be scanned, the current path ⑤ precedes the current paths ① to ④. As a result, the resetting of a capacitor C of a certain pixel circuit and an OEL element related thereto corresponds to the resetting period (current path ⑤), which becomes the resetting period of the next scan line in the table shown in FIG. 2.

In the case where the resetting period succeeds the light emission period, the line Y whose row side scan is completed, is returned to the initial state and the control signals S1, S2 and S3 become "L", "L" and "L", respectively. Therefore, the switch circuits SW1, SW2 and SW3 are turned OFF in a switching period (retrace line period) of a row side scan line period after the resetting period and returns to the initial state.

In a case where the row lines are not sequentially scanned by the row side scan circuit 7, for example, where one image screen of R, G and B is to be scanned, all of the row lines are pulled down to "L" at a start time of light emission of the OEL elements after the resetting period and pulled up to "H" after the light emission is terminated.

In this embodiment, the peak current for initially charging the OEL element 4*a* is generated as a sum of the drive current from the pixel circuit 4 and the drive current supplied from the constant current source 11. The OEL element 4*a* is driven by the peak current to emit light. However, it is not always necessary to generate the peak drive current by simultaneously generating both the initial charge current and the drive current. The drive current from the pixel circuit 4 may be supplied after the initial charging is performed.

In the latter case, in order to supply current for the initial charge from the constant current source 11 precedently, the switch circuit SW1 is made ON for a constant time necessary for the initial charging. Thereafter, the switch 71 on the pull side of the switch circuit 70 of the row side scan circuit 7 is turned ON and the switch 72 thereof is turned OFF. By this control, it is possible to start the display period for causing the OEL element 4*a* to emit light, after the initial charging.

The initial charging of the capacitor C is performed by the peak current, which is a sum of the write current and the initial charging current by making the switch circuits SW2 and SW3 ON as shown in the current path ① of FIG. 2. However, it is possible to supply the initial charging current and then the write current.

In the latter case, the capacitor C is initially charged by the current from the constant current source 12 by turning only the switch circuit SW2 ON with the control signals S1, S2 and S3 being "L", "H" and "L", respectively, and, thereafter, the switch circuit SW2 is turned OFF by changing the state of the control signal S2 to "L". And then, the switch circuit SW3 is turned ON by changing the stare of the control signal S3 to "H". By this operation, it is possible to write the current in the capacitor C with the current from the constant current source 13 after the initial charging.

Further, in the case where the resetting operation is performed before the time in which the voltage is written in the capacitor C, since the switch circuit SW2 is ON during the time in which the voltage is written in the capacitor C, it is possible to enter into the initial charging of the capacitor C along the current path ① after the discharge of the residual charge on the OEL element 4*a* by turning the transistors Tr1 and Tr2 ON and the transistors Tr4 and Tr5 OFF with the selection line Y1, the selection line Y2 and the erase line Y3 being "L", "L" and "H", respectively, without setting the initial state in which all of the control signals S1, S2 and S3 are set to "L".

Figure 3:
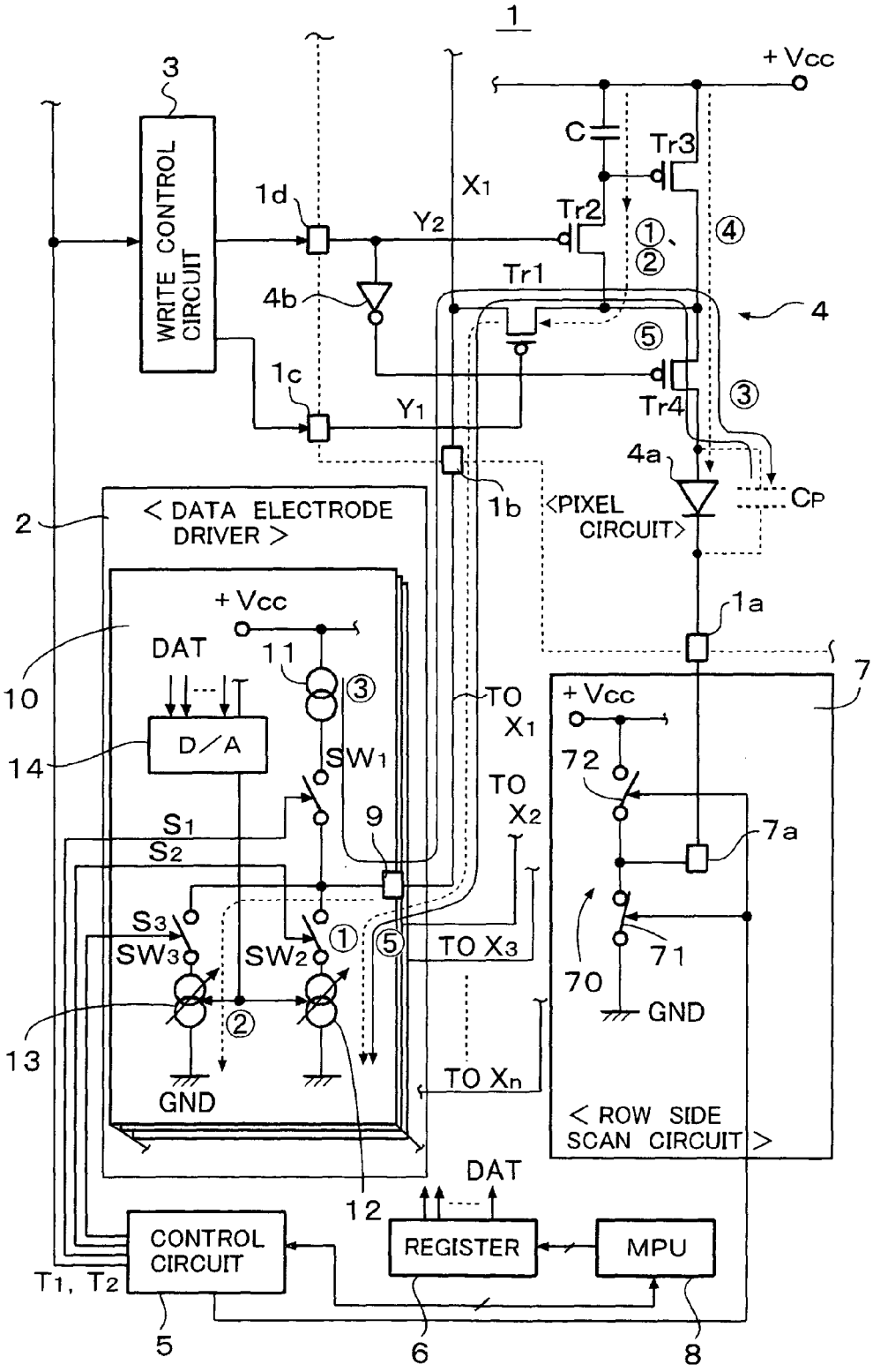
FIG. 3 is a block circuit diagram of an active matrix type organic EL display device according to another embodiment of the current drive circuit.

FIG. 3 shows another embodiment of the present invention, which is different from the embodiment shown in FIG. 1 in that the transistor Tr5 shown in FIG. 1 is removed and the discharge of the capacitor C is performed through the transistor Tr3. Therefore, though the resetting period becomes slightly longer than that in the embodiment shown in FIG. 1, the number of transistors constituting the pixel circuit 4 is reduced to four and the erase line Y3 becomes unnecessary.

The resetting operation of the capacitor C and the OEL element shown in FIG. 3 will be described. When the resetting is performed, the selection lines Y1 and Y2 are made "H" and "L", respectively. Therefore, the transistors Tr1, Tr2 and Tr4 are turned OFF, ON and OFF, respectively. Since the transistor Tr3 is in ON state due to the voltage stored in the capacitor C, the capacitor C is discharged through the transistors Tr3 and Tr2.

Incidentally, in this resetting period, the control signals S1, S2 and S3 are "L", "H" and "L", respectively, and the switch circuits SW1, SW2 and SW3 are kept OFF, ON and OFF, respectively. In view of this, the selection lines Y1 and Y2 are made "L" and "H", respectively, after the capacitor C is discharged. Therefore, the transistor Tr2 is turned OFF and the transistors Tr1 and Tr4 are turned ON. Further, the transistor Tr3 is turned OFF when the discharge of the capacitor C is completed. Therefore, the charge on the parasitic capacitor Cp of the OEL element 4*a* is discharged rapidly through the transistor Tr1, the output pin 9, the switch circuit SW2 and the constant current source 12.

Figure 4:
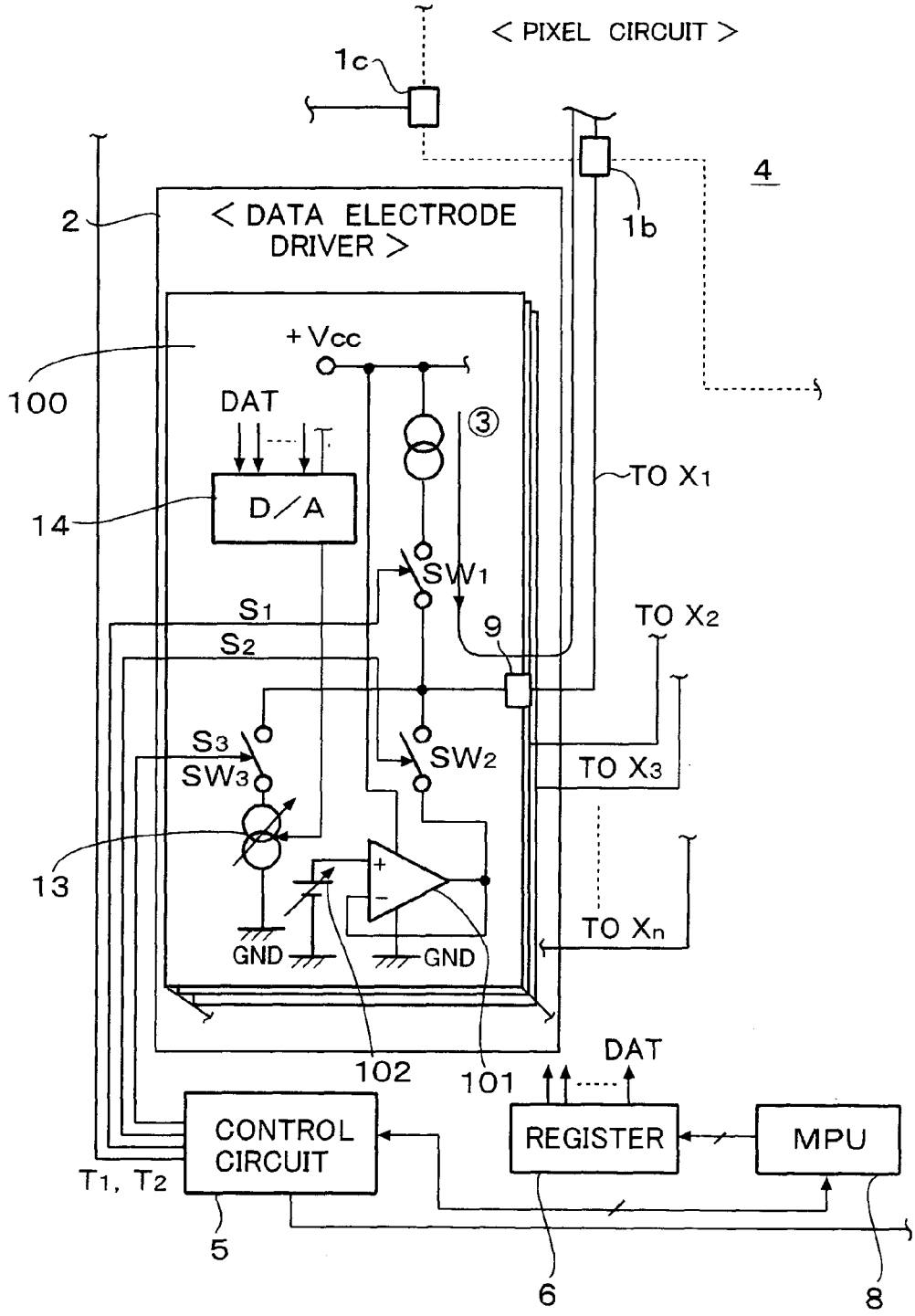
FIG. 4 is a circuit diagram of a display cell drive circuit according to another embodiment of the present invention.

FIG. 4 shows a detailed display drive circuit according to a further embodiment of the present invention.

The display cell drive circuit 100 shown in FIG. 4 may be used as a substitution for the display cell drive circuit 10 shown in FIG. 1 or FIG. 3.

The display cell drive circuit 100 does not have the pull side current source 12 of the display cell drive circuit 10. Instead of the current source 12, the display cell drive circuit 100 includes a constant voltage source 101 (voltage follower), which is connected to the output pin 9 through the switch circuit SW2.

The control operation of the display cell drive circuit 100 is performed along the table shown in FIG. 2. However, the ON/OFF control of the switch circuits in the initial charging of the capacitor C shown in the first line and the resetting shown in the fifth line of the table is different from the drive circuit 10 shown in FIG. 1 or FIG. 3.

Although the control signals S1, S2 and S3 in the resetting control in the first line of the table are "L", "E" and "H", respectively, the control signals S1, S2 and S3 in this embodiment are "L", "H" and "L" , respectively. Therefore, the switch circuits SW1 and SW3 are turned OFF and the switch circuit SW2 is turned ON.

Although the control signals S1, S2 and S3 in the resetting control in the fifth line of the table are "L", "H" and "L", respectively, the control signals S1, S2 and S3 in this embodiment are "L", "L" and "H", respectively. Therefore, the switch circuits SW1 and SW2 are turned OFF and the switch circuit SW3 is turned ON.

The ON/OFF control of the respective transistors of the pixel circuit 4 is the same as that in the embodiment shown in FIG. 1 or FIG. 3.

Describing the initial charge of the capacitor C, the switch circuits SW1 and SW3 are turned OFF and the switch circuit SW2 is turned ON by the ON/OFF control of the respective switch circuits. Therefore, the voltage from the constant voltage source 101 is applied to the capacitor C through the data line X1 and the transistors Tr1 and Tr2, which are turned ON. Thus, the capacitor C is set to the voltage of the constant voltage source 101. Therefore, when the voltage of the constant voltage source 101 is high compared with the voltage of the capacitor C, which is reset, a current corresponding to a difference therebetween flows from the output pin 9. On the other hand, when the voltage source voltage is lower than the capacitor voltage, a current corresponding to a difference therebetween is pulled in the output pin 9. In this case, the amount of current is smaller than that in the embodiment shown in FIG. 1 or FIG. 3.

Incidentally, the voltage of the constant voltage source 101 can be regulated by externally setting data for a programmable voltage generator circuit 102 correspondingly to threshold values of the transistors Tr3 and Tr4 of the pixel circuit 4. By this voltage regulation, it is possible to restrict luminance variation, etc.

Now, the resetting of the capacitor C and the OEL element 4*a* will be described. Since the switch circuit SW3 is turned ON and the switch circuits SW1 and SW2 are turned OFF by the ON/OFF control of the respective switch circuits, the OEL element 4*a* is reset through the transistors Tr4 and Tr1, the output pin 9 and the current source 13. The resetting of the capacitor C is the same as that in the embodiment shown in FIG. 1 or FIG. 3 and is performed by the transistor Tr5, which is ON, or the transistors Tr2 and Tr3, which are also ON.

In this embodiment, the initial charge of the capacitor C is performed by the setting by the constant voltage source 101. The constant voltage source 101 is provided in the display cell drive circuit 100 provided correspondingly to the pixel circuit 4, as shown.

When the voltage setting of the capacitor C in this manner, it is not always necessary to provide the constant voltage source 101 in the display cell drive circuit 100. For example, the constant voltage source may be provided correspondingly to the data electrode driver 2 of each R, G and B. Alternatively, in the embodiments shown in FIG. 1, FIG. 3 and FIG. 4, the OEL element 4*a* is reset before or after the light emission thereof. However, in the active matrix type organic EL display panel, the resetting of the OEL element 4*a* is not so importance as in the passive matrix type organic EL display panel.

As described, when the capacitor C is to be initially charged, the initial charging of an input capacitor, which parasites to a gate of the transistor Tr3 is performed simultaneously. Further, an input capacitance of the transistor connected to the drive line of the capacitor C and a stray capacitance, which parasites to the line X1 are also initially charged simultaneously. Therefore, it is possible to reduce a time from the drive of the OEL element 4*a* to the light emission and to improve the initial drive characteristics till the light emission.

The display cell drive circuit 10 of the embodiment is constructed with a push-pull type current drive circuit to initially charge the parasitic capacitor Cp of the OEL element 4*a* and the capacitor C by the push side current of the current drive circuit and the pull side current thereof, respectively, to thereby perform the writing of the drive current. However, it is possible to initially charge the capacitor C and write the current value therein by the push side current of the current drive circuit and initially charging the parasitic capacitor Cp of the OEL element 4*a* by the pull side current thereof by changing the construction of the pixel circuit in such a way that N channel MOS transistors are used instead of the P channel MOS transistors.

Further, in the display cell drive circuit 10, the switch circuits SW1, SW2 and SW3 are provided in series with the current sources 11, 12 and 13 or the voltage source 101 connected to the output pin 9, respectively, and, by the ON/OFF control of the switch circuits SW1, SW2 and SW3, a current is supplied from the current source 11 (or the voltage source 101) to the output pin 9 or a current is sunk from the output pin 9 by the current source 12 (or the voltage source 101) and the current source 13. However, it is, of course, possible that, by using a circuit construction in which the respective currents are generated by selectively actuating the current sources (voltage sources) directly or the generation of the current is stopped according to the control signals S1, S2 and S3, without providing the switch circuits SW1, SW2 and SW3 connected in series with the respective current sources (voltage sources).

Further, although, in the described embodiments, the push-pull switch circuit is used as the switch circuit of the row side scan circuit 7, the switch circuit may be any, provided that it has a discharge path of charges of the parasitic capacitor Cp of the OEL element 4*a*.

Further, for a monochromatic display panel, a single current drive circuit may be employed.

Incidentally, although the drive circuit is constructed with mainly MOS FETs in the embodiments, it is, of course, possible to construct it with bipolar transistors. Further, the N channel type transistors (or npn type) in the described embodiments can be replaced by P channel type transistors or vise versa. In such case, the source voltage is negative and the transistors provided upstream side may be provided downstream side.

It should be noted that the output pin may include an output terminal formed as a bump connected to an IC pad.

What is claimed is:

1. A drive circuit of an active matrix type organic EL display panel, for current-driving an active matrix type organic EL display panel having a plurality of pixel circuits arranged in matrix, each said pixel circuit including an organic EL element, a capacitor for storing a voltage value corresponding to a value of a drive current of said organic EL element and a plurality of transistors for supplying the drive current to said organic EL element correspondingly to the voltage value, said drive circuit comprising:

a plurality of current drive circuits each provided for a data line or a column pin of said organic EL display panel, each said current drive circuit having an output pin connected to said data line or said column pin and generating a current for charging said capacitor of each said pixel circuit through said data line or said column pin and a current for initially charging said organic EL element; and a write control circuit for controlling a write for storing the voltage value in said capacitor and for controlling a resetting the written voltage value of said capacitor, wherein the current for charging said capacitor to the voltage value is generated correspondingly to one of a current pulled out from said output pin to said pixel circuit and a current pulled in from said pixel circuit to said output pin and the current for initially charging said organic EL element is generated correspondingly to one of another current pulled out from said output pin to said pixel circuit and another current pulled in from said pixel circuit to said output pin.

2. A drive circuit of an active matrix type organic EL display panel, as claimed in claim 1, wherein, in order to charge said capacitor of said pixel circuit connected to each said current drive circuit to the voltage value through said output pin within a short time, each said current drive circuit comprises a charging circuit for generating a current or a voltage for initially charging said capacitor of said pixel circuit.

3. A drive circuit of an active matrix type organic EL display panel, as claimed in claim 2, wherein said current drive circuit is constructed with a push-pull type current output circuit, a push side of said current output circuit pulling out a current from said output pin to said pixel circuit and pull side of said current output circuit pulling in from said pixel circuit to said output pin.

4. A drive circuit of an active matrix type organic EL display panel, as claimed in claim 3, wherein said write control circuit resets said capacitor immediately before the voltage value is written in said capacitor and said current drive circuit resets said organic EL element immediately before said organic EL element is driven.

5. A drive circuit of an active matrix type organic EL display panel, as claimed in claim 4, wherein the voltage resetting of said organic EL element of said pixel circuit is performed when said current drive circuit pulls in a current to said output pin of said current drive circuit.

6. A drive circuit of an active matrix type organic EL display panel as claimed in claim 4, wherein the voltage resetting of said capacitor is performed when a transistor connected in parallel to said capacitor is turned ON.

7. A drive circuit of an active matrix type organic EL display panel, as claimed in claim 6, wherein said push side circuit includes a first current source for initially charging said organic EL element connected to said output pin through a first switch circuit, said pull side circuit includes a second current source connected to said output pin through a second switch circuit and a third current source connected to said output pin through a third switch circuit for charging said capacitor, said second current source constituting said charging circuit for generating the current for initially charging said capacitor, said third current source generating the current for writing the voltage value in said capacitor.

8. An organic EL display device comprising an active matrix type organic EL display panel claimed in claim 7 and a controller, wherein said organic EL element is initially charged by said first current source under a control of said controller and said capacitor is initially charged and written with the voltage value by said second and third current source under a control of said controller.

9. An organic EL display device comprising a drive circuit as claimed in claim 8, wherein said controller generates a first control signal, a second control signal and a third control signal, an initial charge of said organic EL element is performed by turning the first switch circuit ON with said first control signal, the initial charge of the capacitor is performed by turning the second switch circuit ON with said second control signal and writing the voltage value in said capacitor is performed by turning the third switch circuit ON with said third control signal.

10. A drive circuit of an active matrix type organic EL display panel, as claimed in claim 6, wherein said push side circuit includes a first current source connected to said output pin through a first switch circuit and initially charging said organic EL element and said pull side circuit includes a second current source connected to said output pin through a second switch circuit and generating a current for writing the voltage value in said capacitor, and further comprising a voltage source connected to said output pin through a third switch circuit, said voltage source constituting said charging circuit for generating the current for initially charging said capacitor.

11. An organic EL display device having said active matrix type organic EL display panel claimed in any of claims 1 to 10.

12. An organic EL display device as claimed in claim 11, wherein said pixel circuit includes a first, second, third and fourth P channel MOS transistors, a gate and drain of said first transistor are connected to a selection line and said data line, respectively, at a cross point of said selection line and said data line, a source of said first transistor is connected to a gate of said third transistor through a drain-source of said second transistor, said capacitor is connected between a source and a gate of said third transistor, said source of said third transistor is connected to a power source line, a drain of said third transistor is connected to a source of said fourth transistor and a drain of said fourth transistor is connected to an anode of said organic EL element.

13. An organic EL display device as claimed in claim 12, wherein said write control circuit initially charges said organic EL element by supplying the current for charging said organic EL element by turning said first and fourth transistors ON and initially charges said capacitor and writes the voltage value in said capacitor by sinking a current from said output pin by turning said first and second transistors ON.

14. An organic EL display device as claimed in claim 13, further comprising a fifth P channel MOS transistor arranged in parallel to said capacitor, wherein said write control circuit resets the voltage value of said capacitor by turning said fifth transistor ON.

15. An organic EL display device comprising a drive circuit as claimed in claim 10 and a controller, wherein said organic EL element is initially charged by said first current source under a control of said controller, said capacitor is initially charged by said voltage source under a control of said controller and the voltage value is stored by said second current source under a control of said controller.

16. An organic EL display device as claimed in claim 11, wherein said pixel circuit includes a series circuit composed of a first and second MOS transistors for driving said organic EL element and a third and fourth MOS transistors for writing the voltage value in said capacitor, said capacitor is connected between a gate of said first MOS transistor and one of a source and a drain of said first MOS transistor, one of a source and a drain of said second MOS transistor is connected to an anode of said organic EL element, said third MOS transistor in connected between a gate of said first MOS transistor and the other of said source and drain of said first MOS transistor, said fourth MOS transistor is connected between the other of said source and drain of said first MOS transistor and said output pin of said current drive circuit, one of said gates of said second and third MOS transistors is connected to the other gate through an inverter, and said write control circuit performs the write control by supplying control signals to said gate of said fourth MOS transistor and said gate connected to an input side of said inverter to ON/OFF control said second, third and fourth MOS transistors.

17. An organic EL display device as claimed in claim 16, wherein said pixel circuit further includes a fifth MOS transistor connected in parallel to said capacitor for discharging said capacitor and said write control circuit resets the written voltage value of said capacitor by turning said fifth MOS transistor ON.

* * * * *